US008597444B1

(12) United States Patent
Young et al.

(10) Patent No.: US 8,597,444 B1
(45) Date of Patent: Dec. 3, 2013

(54) FOAMED CELLULOID COMBUSTIBLE MATERIAL

(75) Inventors: Ming-Wan Young, Basking Ridge, NJ (US); Costas G. Gogos, Wyckoff, NJ (US); Niloufar Faridi, Melville, NY (US); Linjie Zhu, Livingston, NJ (US); Peter Bonnett, Succasunna, NJ (US); Howard Shimm, Budd Lake, NJ (US); Elbert Caravaca, Budd Lake, NJ (US); Joseph Palk, Jr., Ledgewood, NJ (US); Dale Conti, Flanders, NJ (US); Mohamed Elalem, East Orange, NJ (US); Fei Shen, North Arlington, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 222 days.

(21) Appl. No.: 12/977,374

(22) Filed: Dec. 23, 2010

Related U.S. Application Data

(63) Continuation-in-part of application No. 12/125,474, filed on May 22, 2008, now abandoned, and a continuation-in-part of application No. 12/483,420, filed on Jun. 12, 2009.

(60) Provisional application No. 60/939,660, filed on May 23, 2007, provisional application No. 61/061,249, filed on Jun. 13, 2008.

(51) Int. Cl.

| | |
|---|---|
| ***C06B 45/10*** | (2006.01) |
| ***C06B 25/00*** | (2006.01) |
| ***C06B 25/18*** | (2006.01) |
| ***D03D 23/00*** | (2006.01) |
| ***D03D 43/00*** | (2006.01) |

(52) U.S. Cl.
USPC ..... 149/19.8; 149/88; 149/96; 149/108.4; 149/109.4

(58) Field of Classification Search
USPC ..... 149/19.8, 88, 96, 108.4, 109.4
See application file for complete search history.

(56) References Cited

U.S. PATENT DOCUMENTS

| | | | | |
|---|---|---|---|---|
| 3,687,746 | A * | 8/1972 | Spenadel et al. | 149/2 |
| 3,711,343 | A * | 1/1973 | Dunigan et al. | 149/2 |
| 3,718,719 | A * | 2/1973 | Olsen | 264/3.3 |
| 5,048,421 | A * | 9/1991 | Swartout | 102/431 |
| 5,206,011 | A * | 4/1993 | Pappas et al. | 424/61 |
| 6,170,399 | B1 * | 1/2001 | Nielson et al. | 102/336 |
| 2001/0042578 | A1 * | 11/2001 | O'Meara et al. | 149/96 |
| 2005/0100518 | A1 * | 5/2005 | Ilekti et al. | 424/61 |
| 2009/0110905 | A1 * | 4/2009 | Starostenko | 428/305.5 |
| 2011/0240904 | A1 * | 10/2011 | Chiou et al. | 252/62 |

OTHER PUBLICATIONS http://www.powerlabs.org/chemlabs/nitrocellulose.htm.*

* cited by examiner

*Primary Examiner* — James McDonough
(74) *Attorney, Agent, or Firm* — Henry S. Goldfine

(57) ABSTRACT

By using generally known chemically, physically, or a combination thereof, means to foam celluloid, a foamed celluloid material is invented with a density of less than about 1.25 gm/cm$^3$, which material is relatively low cost, very fast burning, very low residue, easily moldable, and which material exhibits good mechanical strength, and provides a good water barrier. These characteristics make this foamed celluloid a preferred choice for military artillery propellant charge bags, military mortar and civilian fireworks increment charges, combustible cartridges, flare housings, igniter tubes, as well as, closure disks, combustible enclosures and components thereof, among other applications.

13 Claims, No Drawings

FOAMED CELLULOID COMBUSTIBLE MATERIAL

CROSS-REFERENCE TO RELATED APPLICATIONS

This application is a continuation-in-part of currently co-pending U.S. patent application Ser. No. 12/125,474, filed May 22, 2008, which application claimed the benefit under 35 USC §119(e) of U.S. provisional patent application 60/939,660, filed on May 23, 2007 and Ser. No. 12/483,420, filed Jun. 12, 2009, which application also claimed the benefit under 35 USC §119(e) of U.S. provisional patent application 61/061,249, filed on Jun. 13, 2008. Both U.S. patent application Ser. Nos. 12/125,474 and 12/483,420 and both provisional applications 60/939,660 and 61/061,249 are hereby incorporated herein by reference.

FEDERAL RESEARCH STATEMENT

The invention described herein may be manufactured, used, and/or licensed by the U.S. Government for U.S. Government purposes.

FIELD OF THE INVENTION

The present invention relates to the manufacture and use of foamed celluloid, a fast burning, low residue, combustible material.

BACKGROUND OF THE INVENTION

Celluloid is regarded as the first thermoplastic material, a material created by Alexander Parkes in 1862, by mixing cellulose nitrate with camphor to produce a hard, flexible material which he trade named Parkesine. Today, celluloid is generally considered to be a class of materials created from nitrocellulose and camphor, which is highly flammable. Typically, celluloid is composed of 70 to 80 parts nitrocellulose, nitrated to 11% nitrogen, and about 30 parts camphor, which acts as a plasticizer for the nitrocellulose, plus small parts dyes, ethyl alcohol, stabilizers and other ingredients to increase stability and reduce flammability.

Commercial manufacture of celluloid typically involves mixing nitrocellulose and camphor in the presence of solvents, such as ethanol and acetone. A common celluloid manufacturing process, known as "blocking," involves mixing the nitrocellulose, camphor, and other ingredients, followed by straining, roll milling and "hiding". A selected number of "hides" are then blocked at a desired pressure and temperature into a fused block, which is then sliced into sheets at desirable thickness after a conditioning period. Alternatively, celluloid can be manufactured by "film casting," which involves mixing nitrocellulose, camphor, and other ingredients, and subsequently casting, and drying, the mixture into film sheets of a desired thickness.

As stated above, other than nitrocellulose and camphor, celluloid may contain a number of other ingredients, or additives, such as dyes and fillers for various applications. Common applications for celluloid, today, include guitar picks, ping-pong balls, and some writing and musical instruments.

It is known that celluloid can easily be formed into relative rigid structures of relatively complex geometries and is useful for casings for explosives, or flares, or munitions; however, the various combustible applications experience burn residue issues, as well as, other issues of mechanical strength and embrittlement, especially at low temperatures. Of these issues, burn residue issues are the most problematic; especially when, celluloid is used as the material of construction for combustible increment containers for pyrotechnic or military mortars (aka mortar increment charges or MICs), and in other artillery propulsion systems—burn residue can obstruct launch tubes of the various projectile/artillery systems. Any such obstruction, within a launch tube, can lead to misfires or hang fires, which could result in an untimely detonation of the projectile, with significant potential for injury or death to the crew.

Thus there is a need in the art for a relatively low cost celluloid replacement—that can be easily mass produced; which material is easily moldable—to facilitate desired geometries; which material is completely combustible—to avoid residue problems; and which material does not suffer from embrittlement or mechanical strength issues—especially at lower temperatures.

SUMMARY OF INVENTION

The present invention addresses the cost and structural needs not met by the prior art celluloid material for a flammable, very fast burning, combustible material—by providing a low residue, combustible, moldable material, that is easily manufactured, does not suffer from cold issues, and is significantly cost effective—which is useful in almost any application requiring such an almost completely flammable and residue free material. Specifically, the present invention comprises any foamed celluloid with a density significantly less than the density of unfoamed celluloid (which is about 1.40 gm/cm$^3$), preferably about 1.25 gm/cm$^3$ or less. Such foamed celluloid, with a density of from about 1.25 gm/cm$^3$ to about 0.05 gm/cm$^3$, can be readily customized for a wide range of military and civilian applications by providing a comprehensive coverage in physical strength and burn residue requirements. Examples of such particular applications may include, but are not limited to; flash bang or flare casings; military mortar or civilian fireworks charge containers and enclosures; igniter tubes; combustible casings and cartridges; artillery propellant charge bags; and the like. Such foamed celluloid can be manufactured either by known chemical, physical, or a combination of chemical and physical foaming techniques. A preferably, manufacturing technique involves a combination of chemical and physical foaming (which technique is detailed below). Once foamed, the subject foamed celluloid can be easily molded into whatever particular casing or other configuration desired.

The present inventive foamed celluloid can be manufactured by a process generally similar to that of manufacturing conventional celluloid, using known technology; wherein, the celluloid material is preferably manufactured in sheets, and where the process preferably contains a chemical foaming agent; such that, the sheets can preferably be foamed by a generally known combination of chemical and physical foaming means. As stated, such celluloid sheets, preferably contain a chemical blowing, or foaming, agent (CBA)—which celluloid is preferably manufactured by weighing out the major ingredients therein, such as, 50 to 85 wt percent nitrocellulose (NC), and about 15 to about 50 wt percent plasticizer, preferably camphor; and then weighing out the minor ingredients therein, which preferably include a CBA, about 0.1 to about 10 wt percent of the combined major ingredients weight, and preferably a stabilizer, which is preferably about 1 to about 3 wt percent of the combined major ingredients weight.

A particularly preferred method of preparing a low residue, fast burning, foamed celluloid of the present invention involves (1) combining 50 to 85 weight percent nitrocellulose, and about 15 to about 50 weight percent plasticizer to form a mixture of the major ingredients; (2) weighing out and combining a chemical blowing agent, about 1 to about 5 wt percent of the major ingredients weight, and a stabilizer, about 1 to about 3 wt percent of the major ingredients weight, which together are combined to form the minor ingredients; (3) combining the major ingredients and the minor ingredients in the presence of an organic solvent, wherein the ratio of the organic solvent to the combined major and minor ingredients is about 1:2 by weight, resulting in a dough like material; (4) straining said dough like material to remove impurities; (5) milling the strained material until it is homogenous; (6) hiding, layering, and blocking the milled material; (7) conditioning the blocked material until solvent content decreases to about 1.5% to about 3% by weight; (8) pressing the material flat; (9) autoclaving the flattened material for about 15 to about 40 minutes, at about 200 degrees Fahrenheit to about 280 degrees Fahrenheit, and about 300 to 1,000 psi; (10) injecting during the autoclaving an inert gas; (11) removing from the autoclave the foamed celluloid with a density of from about 1.25 gm/cm$^3$ to about 0.05 gm/cm$^3$.

As detailed above, preferred components in the subject invention include plasticizers, CBAs, and PBAs. Particularly preferred plasticizers include camphor, naphthalene, naphtyl acetate, phenoloxylacetic acid, naphtholoxylacetic acid, and their anhydrides and esters, naphthelketone, dinaphthylketone, and derivatives of aromatic sulpho acids; with camphor being the most particularly preferred. Particularly preferred CBAs, include, bi-carbonate; phenyl tetrazole; azo compounds (such as azodicarbonamide); and sulfonyl hydrazide; and other gas generating compounds of which more than 50% can decompose to gas at elevated temperature less than 300 degrees Fahrenheit. And, finally, particularly preferred PBAs, include, $N_2$, $CO_2$, Argon, VOC (i.e. pentane, iso-butane); CFC, HFC, and HCFC.

Also, as discussed above, preferably a stabilizer is added to the subject foamed celluloid inventive formulation. As NC tends to degrade over time the stabilizer minimizes such degradation and absorbs the products of such degradation. Preferred stabilizers include 1-methyl-3,3-diphenylurea (aka Akardite II) and ethyl centralite.

The nitrocellulose (NC) useful in the present invention has a about 10.0 to about 13.6% nitration level, most preferably about 10.8 to about 11.6%. This material is, generally transported in water, or ethanol, to present it being dry—a condition under which is become very volatile. Therefore, as detailed above, to obtain the desired organic solvent mixture, it is preferred that the NC used in the subject invention is delivered in ethanol.

Other ingredients can be added to the solute mix in formulating the present invention, such as (1) a colorant, usually added as 0.01 to about 10 wt percent of the total weight of the NC and plasticizer mixture; (2) a nucleation agent—to help control the size of the gas bubbles within the foam structure of the foamed celluloid and therefore the density; (3) a polymeric material having good miscibility with respect to NC—to help form a more homogenous structure—preferred polymeric ingredients being polypropylene carbonate and polyethylene carbonate; and, finally, (4) an energetic plasticizer—to help increase the overall energetic profile of the inventive foamed celluloid. Notwithstanding these other ingredients, it may be desirable to add various functional additives or fillers to the present inventive foamed celluloid, such ingredients may include, but are not limited to, impact modifiers, conductive fillers, and reinforcement fillers.

The nature of the subject invention will be more clearly understood by reference to the following detailed description and the appended claims.

DETAILED DESCRIPTION OF THE INVENTION

The present invention encompasses foamed celluloid density of less than about 1.25 gm/cm$^3$, a material which is very fast burning, and burns almost completely, such that there is minimal residue; such that, it is ideal for any application requiring a highly flammable container, including munitions, fireworks, flash bang, igniter tubes, or other explosive applications; particular examples of which include MICs for military ordinance or civilian fireworks, or for combustible cartridges. Alternatively, the subject inventive foamed celluloid can be utilized as propellant charge bags or containers for launching artillery projectiles—including, for example, use in 105 mm and 155 mm large caliber artillery and tank guns, as well as, large caliber naval guns. Further, the structural strength, water proof nature, low cost, and low weight of the subject inventive foamed celluloid make it an ideal material for munition closure disks—a part, of a generally non-flammable container. Such "closure disks" are generally color coded to indicate training devices versus fully functional devices, as well as, short range versus normal range, etc.—and as the subject inventive foamed celluloid can be easily colored (by simply adding into the formulation the desired colorant)—manufacture of colored closure disks are certainly envisioned as a particular application of the subject invention.

The inventive foamed celluloid is preferably composed of about 50 to about 85% nitrocellulose, having a nitrogen content of from about 10.0 to about 13.6%, and about 15 to about 50% camphor. When such preferred formulation foamed celluloid is used for MICs, the resulting foamed celluloid MICs exhibit equally good wetness performance to alternative unfoamed celluloid; and, being significantly less dense, there is less mass which needs to be consumed during combustion, which in combination with the significantly larger surface area, dramatically increasing flame propagation (i.e. very fast burning) and there is surprisingly much less residue—a feature which is critical to avoid hang fires and potential premature ignition of the mortar round (plus, less mass, lowers the weight of the MIC that must be carried by the soldier in the field). Further, the more flexible foamed structure versus the non-foamed celluloid, enhances the ability of the foamed celluloid to withstand impact and reduces brittleness (especially at lower temperatures).

The most preferred manufacturing process for the inventive foamed celluloid, with a density of less than about 1.25 gm/cm$^3$ is a batch foaming process, which combines both chemical and physical foaming means—wherein the foamable celluloid sheets are foamed in an autoclave, using temperature, pressure and dwell time as the control variables. The foamable celluloid sheets are prepared by creating a mixture of nitrocellulose and camphor in the presence of a mixture of organic solvents, preferably ethanol and/or acetone—generally about 1 part by weight of such a solvent mixture is combined with about 2 parts by weight of solute. The solute can be: (a) a first ingredient mixture of 50 to 85 wt. percent nitrocellulose (generally, a shuddered paper-like material) and 15 to 50 wt. percent plasticizer, preferably camphor (generally, a powder); to the first ingredient mixture, 0.1 to 10 wt percent thereof, of a chemical blowing agent (CBA) is added, preferably about 1 to 5 wt percent (the chemical blowing agent being generally a powder); finally, to this first ingredient and CBA mixture, about 1 to about 3 wt percent of a stabilizer is added. Using known celluloid manufacturing techniques, these ingredients are formed into dried celluloid sheets, which sheets are placed in a autoclave for about 1 to 120 minutes, most preferably for about 5 to about 40 minutes; under from about 100 to about 10,000 psi, most preferably about 250 to about 1000 psi; and about 180 degrees Fahrenheit to about 320 degrees Fahrenheit, preferably about 200 degrees Fahrenheit to about 280 degrees Fahrenheit. The pressure in the autoclave is created by the injection into the autoclave of a physical blowing agent (PBA), i.e. an inert gas, at the desired pressure. After the stated hold time, foamed celluloid sheets, having the inventive about 1.25 to about 0.05 gm/cm$^3$ density, are attainable from this process; however, it must be stated, that while it is easiest and most efficient to manufacture the subject inventive foamed celluloid in sheet form, the foamed celluloid can be manufactured as strips, cubes, or any other physical form desired.

The inventive foamed celluloid, manufactured as detailed above into sheets, can be easily formed into almost any final shape for the particular application desired (e.g. MICs or cases for combustible cartridges or closure disks) using known thermoforming techniques; wherein the foamed celluloid sheets are heated to a pliable forming temperature, and pressed into the desired shape. So for example, to form the U-shaped halves of an MIC, each thermoformed generally u-shaped half is punched/trimmed out of the sheet from which it was formed, and the two halve joined, using vibration welding to form a single MIC. A fill hole can be left open within the now formed MIC, to allow filling with conventional munition propellants and then sealed using a foamed celluloid plug, paper or nitrated tape, glued into place or sealed using a solvent. A solvent may also be used with or in place of welding of the two halves, by applying the solvent to the edges of one or both sides of the two halves. Preferably, the two halves should be joined by a combination of vibration welding and the use of a solvent, to ensure that the best seam possible is created, to avoid the possibility of a rupture of the seam or an incomplete seam and loss of propellant therefrom.

The flame propagation and energy release of foamed celluloid of the present invention can be evaluated by the combustion performance thereof, which is commonly characterized by the burn rate (cm/sec) obtained from a conventional closed bomb test. Use of conventional closed bomb tests are known in the art, as demonstrated by a Picatinny Arsenal Report, Modernization of Closed Bomb Testing for Acceptance of Single Based Propellants, by John K. Domen, May 1976, available from the Defense Technical Information Center Online, www.DTIC.mil, document No. ABD015387, included herein by reference. The burning rate of foamed celluloid versus unfoamed celluloid of the prior art, is summarized in Table 1, below

TABLE 1

Closed bomb test results for selected Celluloid Compositions.

| Alternate Materials | Nitro-cellulose (NC) Content (Wt. %) | Camphor Content (Wt. %) | Nitrogen (N) Content (Wt. %) | Velocity (V) - from Closed Bomb Tests - (at 1,000 bar, in cm/sec) |
|---|---|---|---|---|
| Non-foamed Celluloid | 80 | 20 | 11.1 | 2.1 |

TABLE 1-continued

Closed bomb test results for selected Celluloid Compositions.

| Alternate Materials | Nitro-cellulose (NC) Content (Wt. %) | Camphor Content (Wt. %) | Nitrogen (N) Content (Wt. %) | Velocity (V) - from Closed Bomb Tests - (at 1,000 bar, in cm/sec) |
|---|---|---|---|---|
| Foamed Celluloid (of the present invention, density 0.10 g/cm$^3$) | 80 | 20 | 11.1 | 89.0 |
| NC Felted Fiber | 75 | N/A | 13.6 | 120.0 |

As can be seen from Table 1, above, the foamed celluloid of the present invention outperforms unfoamed celluloid in burn velocity by, surprisingly, as much as over 40 times, i.e. over 4,000%. For further comparison, the burn rate of NC Felted Fiber (the current commercial material of construction for MICs) containing more than 75% of military grade NC with an extremely high nitration level (13.6% N) was also tested—which test resulted in a demonstrated V of 120.0 cm/sec. Therefore, also unexpectedly, the burn velocity of the foamed celluloid with an NC having a modest nitrogen content of only 11.1 is shown to approach that of the NC Felted Fiber with a high 13.6 wt. percent N content. And, importantly, the cost for a foamed celluloid mortar MIC is estimated at approximately 40% of that of a current equivalent felted fiber mortar MIC considering facilities, manufacturing and materials costs.

The degree of complete combustion, i.e. burning residue, of the foamed celluloid of the present invention was evaluated for use in 120 mm mortar increment containers (MICs) according to an accepted test procedure, International Test Operations Procedure (ITOP) 4-2-504(3), Safety Testing of Mortar Ammunition. The procedure involved firing a mortar shell with MICs of the alternate materials being tested and collecting and weighing the residue from the mortar tube itself and from a tarp laid in the area surrounding the mortar tube. The results are shown in Table 2, immediately below.

TABLE 2

Average weight of residue collected from the debris field and mortar tube.

| Sample | Felted Fiber MIC (control) | Conventional Celluloid MIC | Foamed Celluloid MIC (of the present invention, density 0.6 g/cm$^3$) |
|---|---|---|---|
| Residue Weight (gms) | 0.36 | 0.73 | 0.12 |
| Increased residue vs. inventive Foamed Celluloid MIC | 200% | >500% | N/A |

As shown above, the current MIC material of manufacture for military mortars, felted fiber, left 0.36 grams of residue which was about 200% greater than the 0.12 grams remaining from an equivalent MIC of the foamed celluloid of the present invention. This reduction is surprising and very significant—to avoid the potential for residue build-up in the mortar tube and a resulting misfire and potential premature detonation of the mortar round. Further, it is fully expected that foamed celluloid containers with densities of less than the 0.6 g/cm$^3$ will leave significantly less residue than the 0.6 g/cm$^3$ foamed celluloid material.

As stated above, the foamed celluloid MICs, for example, are relatively easy to manufacture from foamed celluloid sheets which are formed into the desired MIC shape using known thermoforming techniques. The foamed celluloid sheets are heated to a temperature at which they are pliable enough to be pressed into the generally u-shaped MIC halves using conventional thermoforming equipment such as manufactured by Illig Maschinenbau GmbH & Co Kg, Heilbronn, Germany. Each thermoformed u-shaped half is punched/trimmed out of the sheet from which if was formed, and the two halve joined, using vibration welding to form a single MIC. A fill hole can be left open within the newly formed MIC, to allow filling with conventional munition propellants and then sealed using a cover or plug, which can be manufactured of foamed celluloid or nitrated paper. Such a cover or plug can be affixed in place using a solvent, such as acetone. A combination of vibration welding and application of a solvent may also be used to join the two halves, by applying the solvent to the edges of one or both sides of the two halves. Preferably, the two halves should be joined by a combination of vibration welding and the use of a solvent, to ensure that the best seam possible is created to avoid the possibility of a rupture of the seam, or an incomplete seam, and loss of propellant therefrom.

Following are particular examples of step-by-step preferred processes for the manufacture of the subject foamed celluloid—further detailing what is disclosed above.

EXAMPLE 1

A Preferred Combined CBA/PBA Process for the Manufacture of the Inventive Foamed Celluloid 1. In a mixer that can be heated, such as a Measuring Mixer manufactured by Brabender GmbH & Co., Duisburg, Germany, combine about 50 weight % nitrocellulose (NC), having a nitrogen content of from 10.0 wt. % to 13.6 wt. %, preferably lower than 12.6% and most preferably about 10.6% to about 11.2 wt. %; with about 15 wt. % camphor; with about 3% of a chemical blowing agent (CBA) that will generate $CO_2$ when decomposed, potential CBAs include sodium bicarbonate, azodicarbonamide (commonly referred to as AZ), benzene sulfonylhydrazide, and 5-phenyl tetrazole, and a commercial CBA which are particularly preferred may include Celegon, an azodicarbonamide based compound distributed by Chempoint Corn Inc., Bellevue, Wash.; or SAFOAM FPN3-40, manufactured and distributed by Reedy International Corp., Keyport, N.J.; and about 30% by weight of a solvent, such as a 50%/50% mixture of ethanol and acetone;
2. Run the mixer at a moderate agitation of about 30 rpm, for about 25 to about 35 minutes, at about 120 to about 125° F., until the mixture therein appears to be uniform and consistent;
3. Add an additional quantity of solvent, about 25% of that originally added, increase the rpm of the mixer to about 45 rpm, and increase the temperature to about 150 to about 160° F.;
4. After approximately 30 minutes of additional mixing, the mixture is decanted from the mixer onto a flat surface, e.g. a Teflon sheet, and placed within a conventional heated press, capable of temperatures of up to about 200° F. and pressure of over 10,000 lbs of force;
5. Within the heated press, the material is subjected to about 10,000 lbs of force, at about 160° F., until it sets up as a sheet, at the desired thickness of from about 0.1 to about 10 mm, a few minutes;
6. The now formed non-foamed celluloid sheet, containing a CBA, is then placed under vacuum over night to remove the solvent, forming a dried sheet, with a solvent content of preferably less than 3 wt %;
7. The dried sheet is placed in a conventional autoclave, capable of temperatures of at least 400° F. and pressures of up to 1500 psi;
8. The autoclave is pressurized to from about 250 psi to about 1,000 psi by the injection of a PBA, such as nitrogen, carbon dioxide, or argon, preferably nitrogen or carbon dioxide, and most preferably carbon dioxide, and set at a temperature between about 200° F. and 280° F., for a period of from 5 to 40 minutes, preferably from about 10 minutes to about 20 minutes;
9. The desired foamed celluloid sheet is removed from the autoclave with a density of less that about 1.25 gm/cm$^3$.

EXAMPLE 2

A Preferred PBA Process for the Manufacture of the Inventive Foamed Celluloid 1. A non-foamed celluloid sheet is prepared according to steps 1 through 5, above, except that no CBA ingredient is added;
2. The dried sheet is placed in a convention autoclave, capable of temperatures of at least 400° F. and pressures of up to 15,000 psi;
3. The autoclave is pressurized to from about 2,000 psi to about 12,000 psi, preferably from about 6,000 to about 8,000 psi, by the injection of a PBA, such as nitrogen, carbon dioxide, or argon, preferably nitrogen or carbon dioxide, and most preferably carbon dioxide, and set at a temperature between about 250° F. and about 350° F., preferably between about 250° F. and about 300° F., for a period of from about 10 minutes to about 24 hours;
4. The desired foamed celluloid sheet is removed from the autoclave, the foamed celluloid having a density of less than about less that 1.25 gm/cm$^3$.

The burn rate of the subject inventive foamed celluloid can be enhanced by mixing an energetic additive to the initial nitrocellulose mixture of step 1 of Example 1; a preferred additive is an energetic plasticizer, such as BDNP A/F (1:1 mixture of BIS 2,2-Dinitropropyl acetate and BIS 2,2-Dinitropropyl formal), to provide an overall a higher nitration level.

We claim:

1. A combustible thermoplastic material comprising foamed celluloid having a density of about 1.25 gm/cm$^3$ to about 0.05 gm/cm$^3$, and which material is fast burning and low residue.

2. The low residue, fast burning combustible thermoplastic material of claim 1, wherein the foamed celluloid has a density selected from the group consisting of about 1.25 gm/cm3, about 0.6 gm/cm$^3$, about 0.1 gm/cm$^3$, and about 0.05 gm/cm$^3$.

3. The low residue, fast burning combustible thermoplastic material of claim 1, where the foamed celluloid is used in a container selected from the usages consisting of an artillery propellant bag, a military mortar increment charge, a fireworks increment charge, a flash bang, a flare, an igniter tube, and a combustible cartridge.

4. The low residue, fast burning combustible thermoplastic material of claim 1, wherein the foamed celluloid is formed as a munition closure disk.

5. The low residue, fast burning combustible thermoplastic material of claim 1, wherein the container is formed as a charge bag.

6. A foamed celluloid material which comprises nitrocellulose, a plasticizer and a stabilizer; wherein the foamed celluloid has a density of about 1.25 gm/cm$^3$ to about 0.05 gm/cm$^3$, and which material is fast burning and low residue.

7. The low residue, fast burning, foamed celluloid material of claim 6, wherein the plasticizer is selected from the group consisting of camphor, naphthalene, naphtyl acetate, phenoloxylacetic acid, naphtholoxylacetic acid, and their anhydrides and esters, naphthelketone, dinaphthylketone, and derivatives of aromatic sulpho acids.

8. The low residue, fast burning, foamed celluloid material of claim 6, wherein the stabilizer is selected from the group consisting of 1-methyl-3,3-diphenylurea and ethyl centralite.

9. The low residue, fast burning, foamed celluloid material of claim 6, wherein the nitrocellulose has a about 10.0 to about 13.6 wt % nitration level.

10. The low residue, fast burning, foamed celluloid material of claim 6, wherein the nitrocellulose has an about 10.6 to about 11.2 wt nitration level.

11. A foamed celluloid material which comprises nitrocellulose, a plasticizer, a stabilizer and a chemical blowing agent; wherein the foamed celluloid has a density of about 1.25 gm/cm$^3$ to about 0.05 gm/cm$^3$, and which material is fast burning and low residue.

12. The low residue, fast burning, foamed celluloid material of claim 11, wherein the chemical blowing agent is selected from the group consisting of bi-carbonate, phenyl tetrazole, azodicarbonamide, and sulfonyl hydrazide.

13. The low residue, fast burning combustible thermoplastic material of claim 1, wherein the burn velocity is as much as over 40 times that of non-foamed celluloid.

* * * * *